US005775009A

United States Patent [19]

Marega et al.

[11] Patent Number: 5,775,009

[45] Date of Patent: Jul. 7, 1998

[54] NON-RIGID SHOE FOR A SNOW BOARD

[75] Inventors: Antonello Marega, Volpago del Montello, Italy; Patrizio Roffi, Zurigo, Switzerland; Luciano Tedesco, Caerano San Marco, Italy

[73] Assignees: Tecnica Spa, Treviso, Italy; DNR Sportsystem Ltd., Zurigo, Switzerland

[21] Appl. No.: 744,063

[22] Filed: Nov. 4, 1996

[30] Foreign Application Priority Data

Nov. 16, 1995 [IT] Italy ..... TV95A0137

[51] Int. Cl.[6] ..... A43B 5/04

[52] U.S. Cl. ..... 36/117.5; 36/118.2

[58] Field of Search ..... 36/118.2, 118.4, 36/118.6, 118.7, 117.3, 117.5, 118.9, 119.1, 125

[56] References Cited

U.S. PATENT DOCUMENTS

| | | | |
|---|---|---|---|
| 3,419,974 | 1/1969 | Lange | 36/118.2 |
| 3,494,054 | 2/1970 | Lange | 36/118.2 |
| 4,019,267 | 4/1977 | Sadler | 36/118.2 |
| 4,280,286 | 7/1981 | Sartor | 36/118.2 |
| 4,759,137 | 7/1988 | Lederer | 36/118.9 |

FOREIGN PATENT DOCUMENTS

| | | | |
|---|---|---|---|
| 1117001 | 11/1961 | Germany | 36/117.3 |
| 2043685 | 3/1972 | Germany | 36/118.2 |

*Primary Examiner*—Ted Kavanaugh
*Assistant Examiner*—Anthony Stashick
*Attorney, Agent, or Firm*—Griffin, Butler, Whisenhunt & Szipl

[57] ABSTRACT

There is provided a snow board shoe having a non- rigid structure so that bending and rotation are permitted in the area of the ankle but resistance to release loads, without substantial deformation of the sole, and the transmission of the forces applied by the athlete to the board, both transversely and longitudinally, are ensured by means of the insertion of a preshaped reinforcing element of semi-rigid plastics material which encloses the lower sheet of the upper and an edge portion of the associated arch support, wherein a reinforcing metal sheet or plate is inserted in the reinforcing element and the shoe is completed by a mid-sole of expanded plastics material interposed between the reinforcing element and the sole, the mid-sole being injected directly onto the mounted reinforcing element in such a manner as to surround it externally and partially internally.

4 Claims, 6 Drawing Sheets

NON-RIGID SHOE FOR A SNOW BOARD

BACKGROUND OF THE INVENTION

The present invention relates to a shoe for use with a snow board A particular sporting discipline which takes the name of the equipment used to perform it, that is to say, the snow board, has become increasingly widespread in recent years in the field of so called winter sports. As is well known to enthusiasts, this sport is performed by means of a so-called board of substantially rectangular shape (but nevertheless having narrowed side portions) similar to a windsurfing board, with which descents and manoeuvres on the snow-covered surfaces are carried out by positioning the board on an axis which is more or less inclined transversely relative to the direction of advance or descent of the athlete. The athlete's feet are anchored to two attachments which are provided on the upper surface of the board and which are aligned on a line which is inclined relative to the major axis of the board.

The main movements by which the athlete controls the direction of advance of the board, and therefore also the execution of more or less sharp turns and also the stopping of the board are those of lifting the rear or front edge of the board (that is to say, the edge arranged at the shoulders or in front of the athlete); these movements are controlled by the athlete's feet which bring about the corresponding change in attitude of the board by means of the shoe.

In addition, it must be borne in mind that the normal stance of the athlete provides that his two knees are directed (by bending the legs and inclining the lower portions of the legs) towards an axis which is substantially perpendicular to the upper surface of the board and which is substantially halfway between the attachments for the two feet and shifted slightly towards the front edge of the board. Finally, in order to carry out particular manoeuvres, it is necessary to move the body, however slightly, parallel to the major axis of the board.

It is clear from these brief details that the athlete's feet are anchored to the upper surface of the board in various manners and therefore the features of the shoes and of the attachments have to meet different requirements which sometimes conflict with other more general demands, including especially the comfort of the athlete's foot.

A brief list of these features includes:

(i) the promptness and accuracy of transmission of the commands from the athlete and thus from his feet to the board, (ii) the ability to bend the lower portion of the leg and to bend the ankle;

(iii) the rapidity and simplicity of fastening and releasing the shoes to and from the board, which is even more important than, for example, in the case of ski boots because snow boards do not have the automatic-release safety attachments normally associated with ski boots.

It is clear that the first requirement is satisfied by using a substantially rigid shoe which is anchored to attachments, which are likewise rigid, in a manner similar to ski boots in order to meet the second requirement, however, it is necessary for at least the upper portion of the shoe to be non-rigid. Hitherto, two types of shoe with associated attachments have been provided, that is to say, non-rigid (soft) systems and rigid (hard) systems.

Soft systems, which are the ones predominantly used at present, comprise a relatively soft shoe with a sole produced from rubber, an upper produced from leather or synthetic material and a closure member, for example, having laces. The shoe is anchored to the board by means of rigid attachments, preferably of plastics material, which are secured permanently to the upper surface of the board (analogously to the housings for the feet provided on a windsurfig board) and are composed of a rear support or spoiler and strips which enclose the foot and/or forefoot and which can in their turn be adjusted by means of fastening levers and racks. In this case the only function of the shoe is to hold and protect the foot, while the forces applied to the board are transmitted only by the attachments, with the obvious disadvantage that the play and clearance which inevitably exist between the shoe and the attachment render the transmission of the command from the athlete to the board less prompt and less accurate.

Hard systems comprise a shoe which has a rigid external shell and a light internal shoe (the shell being provided with a tongue and a shaft portion which is also relatively rigid) and therefore this shoe is comparable in terms of functionality to a ski boot or an alpine ski boot.

The attachment is in this case limited to metal clips or the like with which raised parts, for example formed in the area of the toe and the heel of the shoe, interact.

Thus, the force exerted by the athlete is transmitted directly from the shoe to the board, and therefore the promptness and immediacy of the transmission of the commands are certainly better than in the previous case.

However, in this case rotation and bending of the ankles are impeded and the user's comfort is decidedly impaired.

The main aim of the present invention is to provide a snow board shoe in which the defects and problems exhibited by both the previous systems are substantially eliminated while the quality thereof is maintained, and the use of the known type of attachment for fastening to the board is permitted.

A more specific aim of the present invention is to provide a snow board shoe which:

(a) is resistant to any substantial release load applied to the sole;

(b) enables the control forces applied by the athlete or the user to be transmitted both transversely and longitudinally;

(c) permits firm rear support without compromising the bending and rotating of the ankle forwards;

(d) has the comfort features of a conventional non-rigid shoe.

SUMMARY OF THE INVENTION

These and other aims are achieved using a snow board shoe of the type comprising an upper, which is provided with an arch support, and a sole, and having means of fastening to a locking attachment which is integral with the upper surface of the snow board, characterised in that there are interposed between the upper and the sole:

a reinforcing element; and a mid-sole;

the reinforcing element being produced from semi- rigid material and having side walls, which surround and are in contact with the lower sheet of the upper, and having lower walls which contain the place of attachment of the arch support to the upper, and the mid-sole being produced from expanded plastics material and being able to surround the reinforcing element externally and partially internally in such a manner as to form the join between the upper and the sole via the reinforcing element, the shoe also being provided with a rear spoiler which is anchored to the reinforcing element and with a rear shaft portion anchored to the spoiler.

BRIEF DESCRIPTION OF DRAWINGS

The main aspects and the advantages of the present invention will become clear from the following description, given with reference to the drawings, of a preferred embodiment of the shoe according to the invention.

In the drawings.

DETAILED DESCRIPTION

Figure 1:
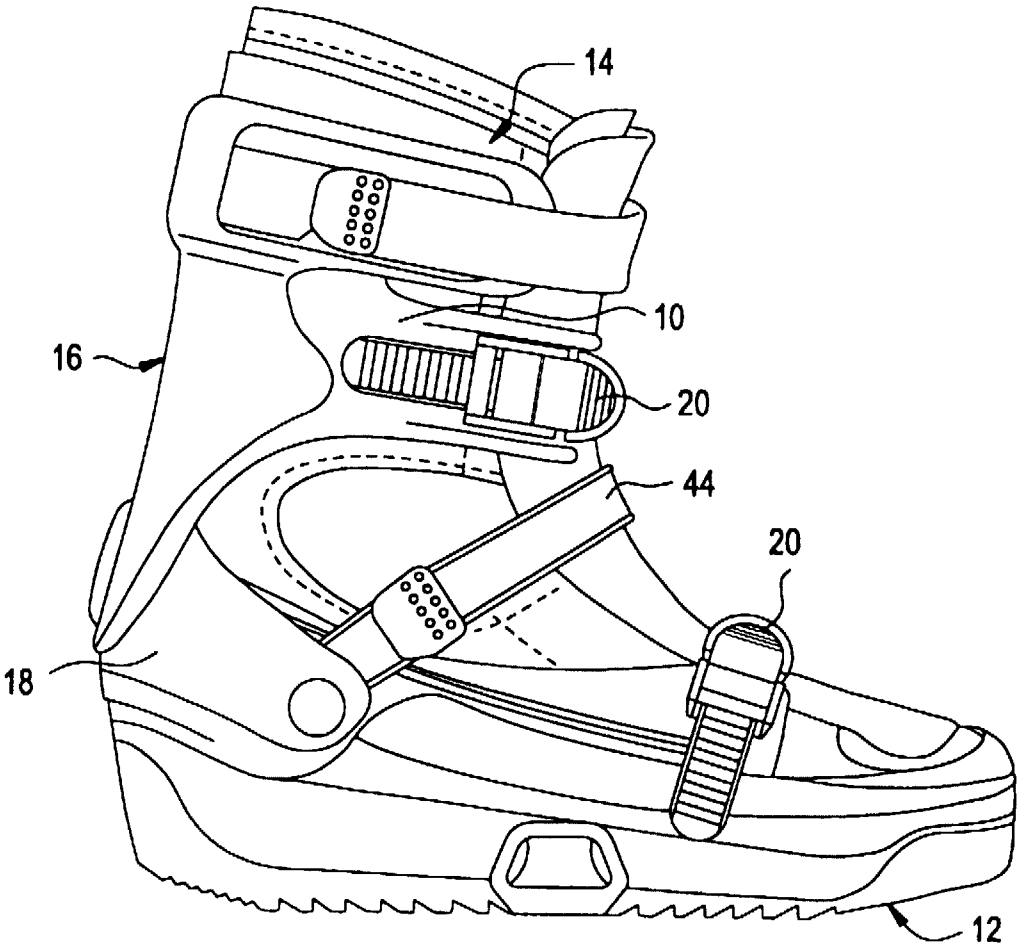
FIG. 1 is a general side view of a snow board shoe according to the present invention.

Referring to the drawings, it should first of all be mentioned that the aesthetic features and some structural aspects of the shoe shown in FIG. 1 are not intended to constitute grounds for limiting unduly the scope of the present invention, being only an example model which incorporates the features forming the subject-matter of the present invention.

Thus, the following components can be seen clearly in FIG. 1:

(1) the upper 10 which is provided with a front opening for the introduction of the foot fitted in a light internal shoe 14, which opening is closed by means of adjustable closure and locking levers 20;

(2) a spoiler 18 which is anchored to the shoe by means of studs 24 in the manner indicated hereinafter and which has the function explained below;

(3) the shaft portion 16 which is secured to the spoiler 18 by means of a stud 22 and which likewise has the function described below.

Figure 2:
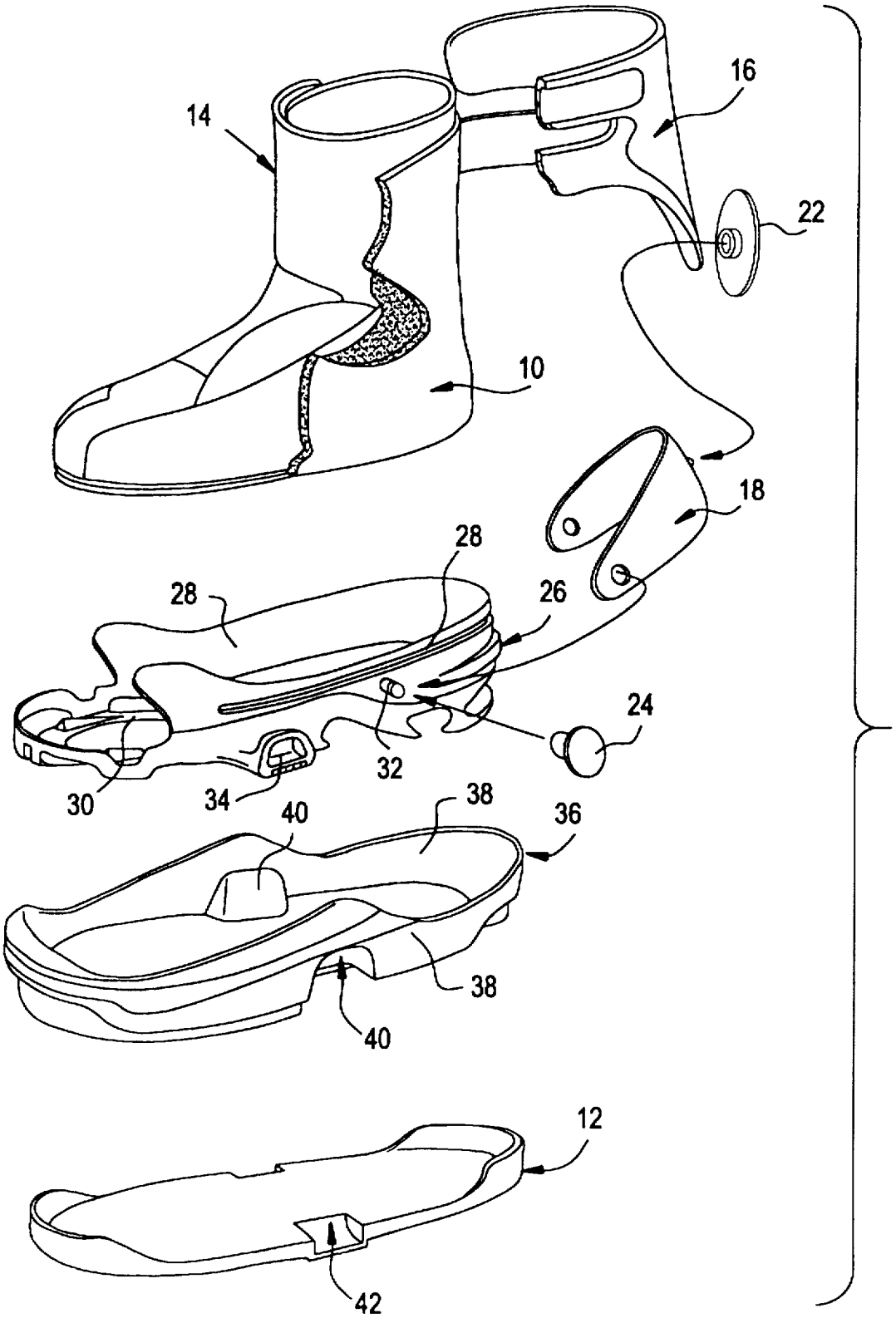
FIG. 2 is an exploded view of the shoe of FIG. 1 shown in its component elements.
Figure 3:
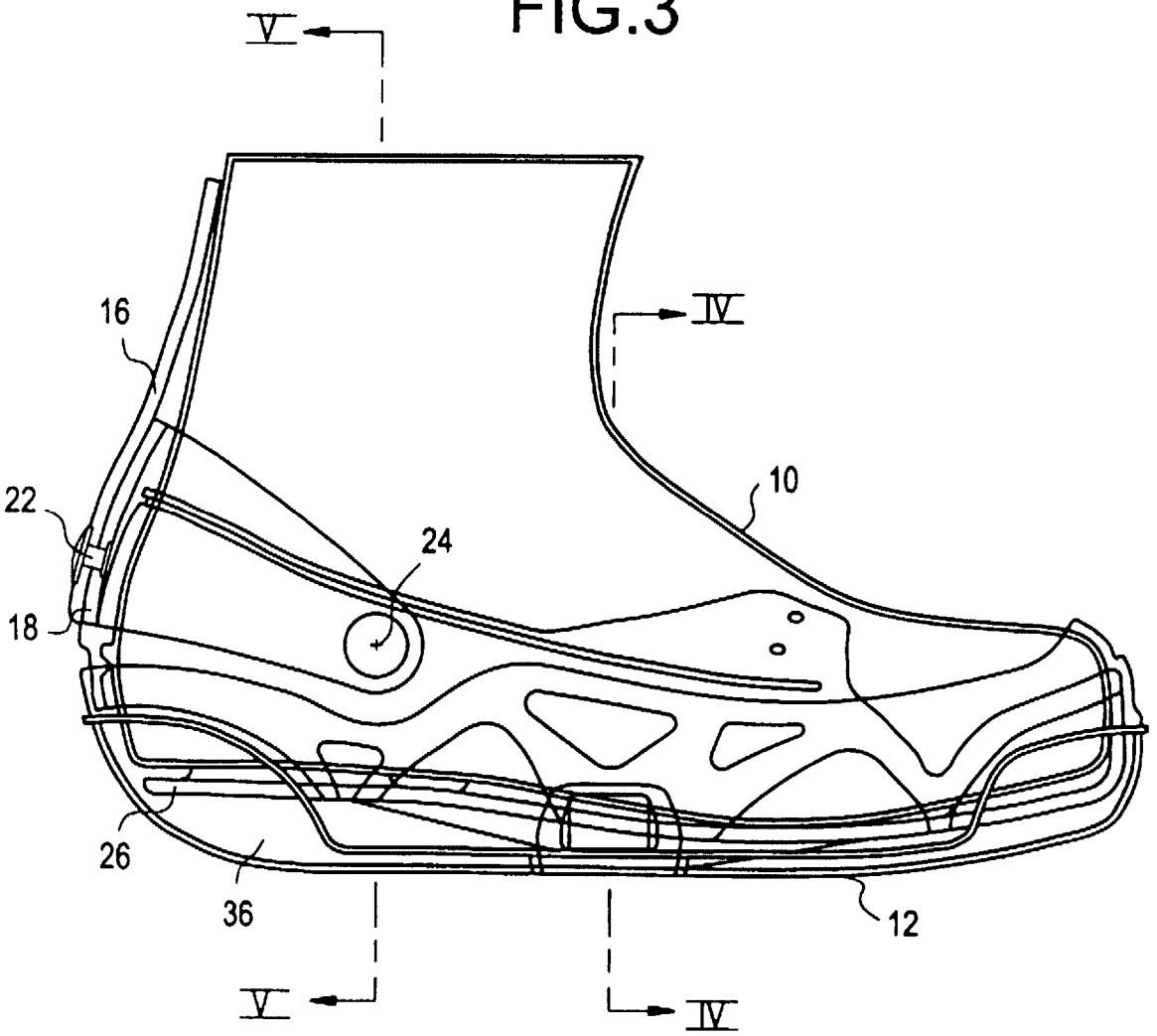
FIG. 3 is a partially sectional side view of the shoe of FIG. 1.
Figure 4:
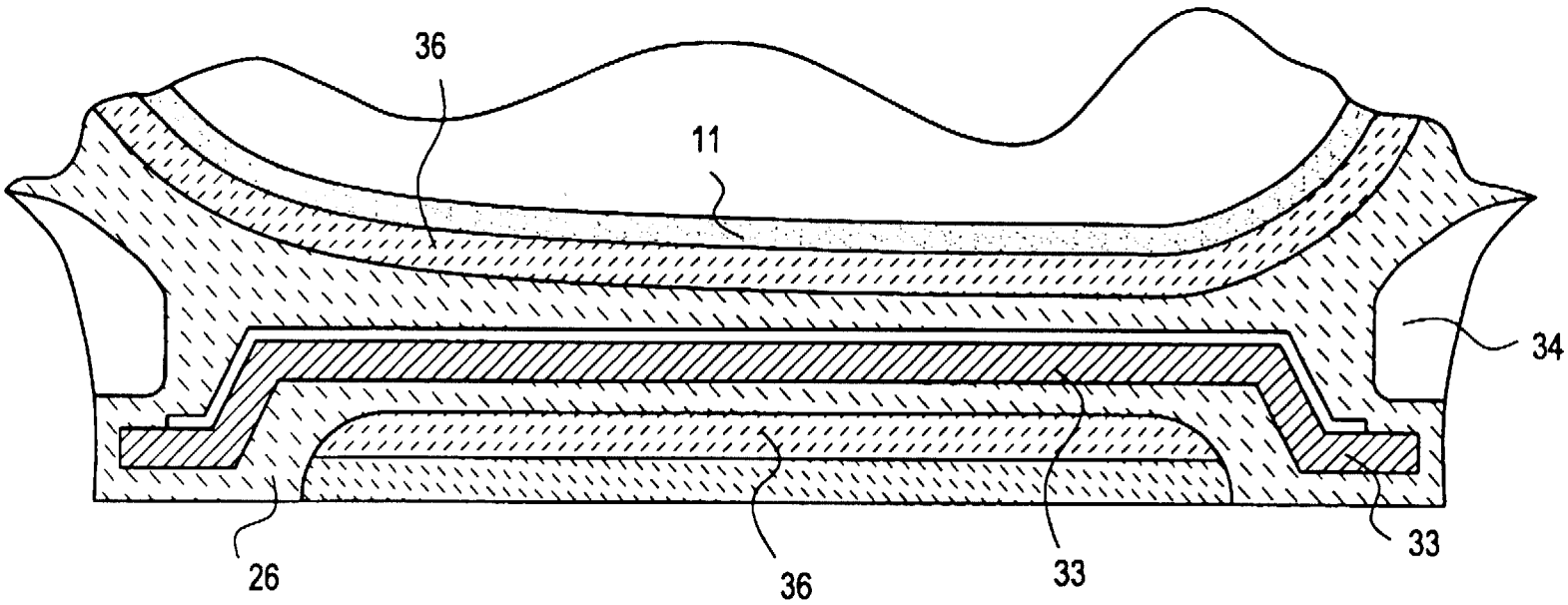
FIGS. 4 and 5B are cross-sections (FIG. 4 being only a partial view) of the shoe of FIG. 1 along the sectional planes IV—IV and V—V of FIG. 3.

Turning now to the structure of the shoe, this is shown in FIG. 2 in exploded form, although some of the components which will now be described are produced during the manufacture of the shoe and not as separate components.

Of the components which are prefabricated separately, mention should first be made of the reinforcement generally indicated 26 which is produced from semi-rigid plastics material (for example by die-forming) and which has a contour and a shape such as to accommodate within it the lower edge of the upper 10 (especially in the area of the stitched arch support (or insole) 11 of the upper). In other words, the reinforcement 26 has a substantially vertical wall 28 with which the lower sheet of the upper 10 comes into contact internally, and a substantially horizontal wall 30 of greatly reduced width against which the external edge of the stitched arch support rests and thus finds a firm support.

It will be readily appreciated from FIG. 2 that the reinforcement 26 has a particular shape, with various relieved portions in the area of the zones in which the material forming the reinforcement does not have a structural function and it is thus possible to provide for relieved portions without detriment to the functionality of the reinforcement.

The reinforcement 26 also has two tubular projections 32 which are aligned transversely relative to the reinforcement and which are used as seats for securing the studs 24 (for example snap or screw studs). In the embodiment shown in FIGS. 1 and 2 a metal sheet or plate 33 is provided in the area of the reinforcement 26 and increases the dissipation of the release forces acting on the sole of the shoe.

A second component of the shoe of FIGS. 1 and 2 is formed by a mid-sole 36 which is arranged between the upper face of the sole 12 and the lower face of the reinforcement 26 and of the stitched arch support of the upper 10 in the area of the part which is not covered and protected by the reinforcement 26.

One portion of the mid-sole 36 is raised to form side walls 38 which in their turn surround the outside of the reinforcement 26 and therefore also the lower sheet of the upper 10. Owing to the fact that, as will be described hereinafter, the mid-sole 36 is produced directly by injecting a suitable expanded plastics material, such as polyurethane, onto the reinforcement 26 already mounted on the upper 10 and on the associated stitched arch support, it is clear that the expanded polyurethane not only forms an external wall for containing the reinforcement 26 and the lower sheet of the upper 10 but also penetrates into the ridged portions of the reinforcement 26, simultaneously performing a function of direct anchorage to the upper, a reinforcing function and a vibration-damping function.

As is shown clearly in FIG. 2, the mid-sole 36 has shaped portions 40 corresponding to the holes 34 in the reinforcement 26 and therefore the holes 34 remain accessible. Likewise, corresponding cavities 42 are formed in the upper surface of the sole 12.

Turning now to the manufacture of the shoe of FIGS. 1 and 2, this involves the following operative stages:

(a) the upper 10 with the associated stitched arch support is mounted or fitted on a former of rigid material such as aluminium;

(b) the reinforcement 26 is applied to the upper 10 thus fitted on the former;

(c) this assembly (fitted upper and reinforcement) is introduced into a die in which the sole 12 is also positioned, and this operation is followed by the injection of the expanded polyurethane which thus forms the mid-sole 36 and at the same time joins the sole 12 and the upper 10 with the interposition of the reinforcement 26;

(d) the shaft portion 16 is then mounted on the spoiler 18 by means of the stud 22 which engages in a corresponding hole in the spoiler; and (e) the whole formed by the spoiler 18 and the shaft portion 16 is applied to the shoe resulting from operations (a–c) by means of the studs 24 and the projections 32.

Referring to FIG. 1, it can be seen that this embodiment also provides for a strap 44 which renders the shoe more rigid; although the heel is held more securely, the ankle is left to move freely. This solution is not absolutely necessary but does not impair the substantial feature of the shoe of the invention, that is to say, the fact that the shoe is substantially non-rigid, with the advantages which, as already mentioned, this shoe has from the point of view of the freedom of the ankles to bend and rotate. Considering now the functionality of the shoe according to the present invention, it will be noted that:

the sole of the shoe is sufficiently reinforced to resist a release load of 250 kg applied thereto without being substantially deformed;

the stiffening structure ensures the transmission of the force applied by the athlete to the snow board, both tranversely and longitudinally, but at the same time it has a low side profile;

the presence of the rear shaft portion provides a firm rear support (generally incompatible with a shoe of the non-rigid type) and at the same time the ankle has sufficient freedom to bend forwards and rotate;

it is compatible with any type of attachment because the hole 34 can be formed at any other position and with a different configuration;

instead of the studs, it is possible to use toothed components which act as regulators of bending and inclination, by borrowing similar devices already produced and used successfully in ski boots.

Figure 5C:
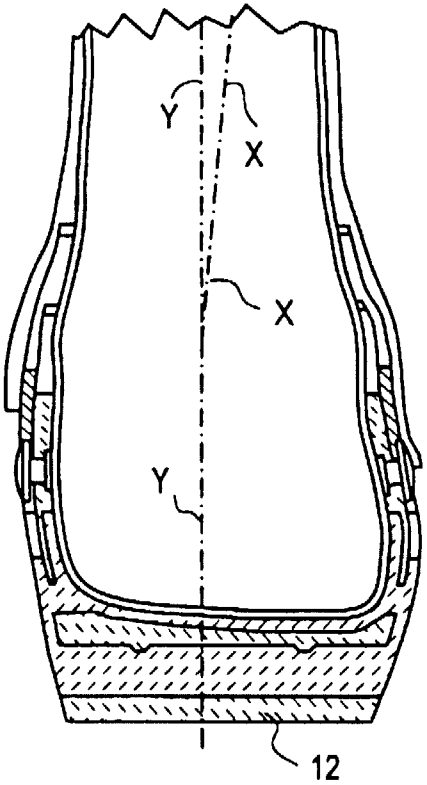
FIGS. 5A and 5C are sectional views analogous to FIG. 5B which illustrate the freedom of lateral inclination of the shaft portion.
Figure 5B:
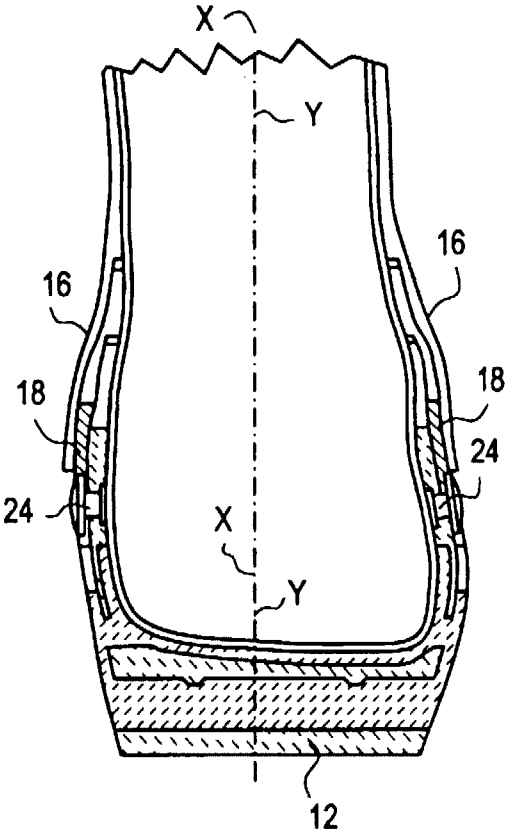
Figure 5A:
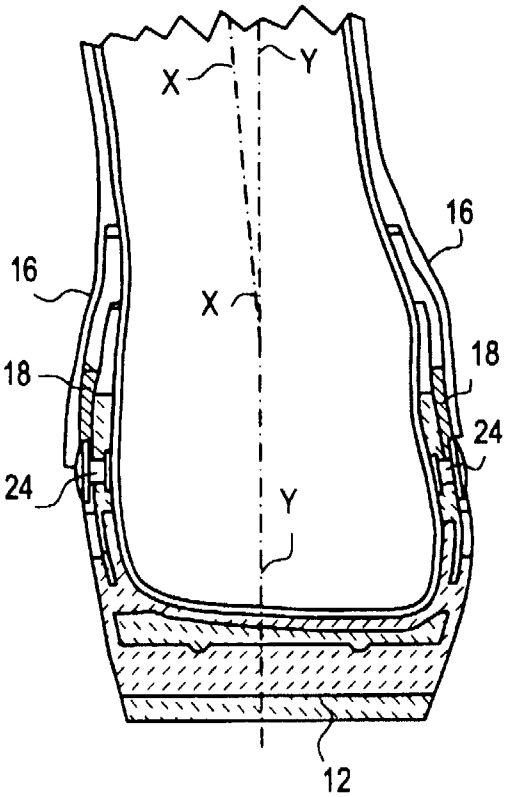

Referring now especially to FIGS. 5A and 5B, which are to be considered in comparison with FIG. 5, it will be immediately appreciated that the shaft portion 16 can be inclined laterally (about the stud 22) without affecting the position of the spoiler 18. This is demonstrated especially by the inclination of the axis of symmetry X—X of the shaft portion relative to the axis of symmetry Y—Y which, in FIG. 5, coincide, whereas in FIGS. 5A and 5B they are inclined relative to one another.

Figure 6B:
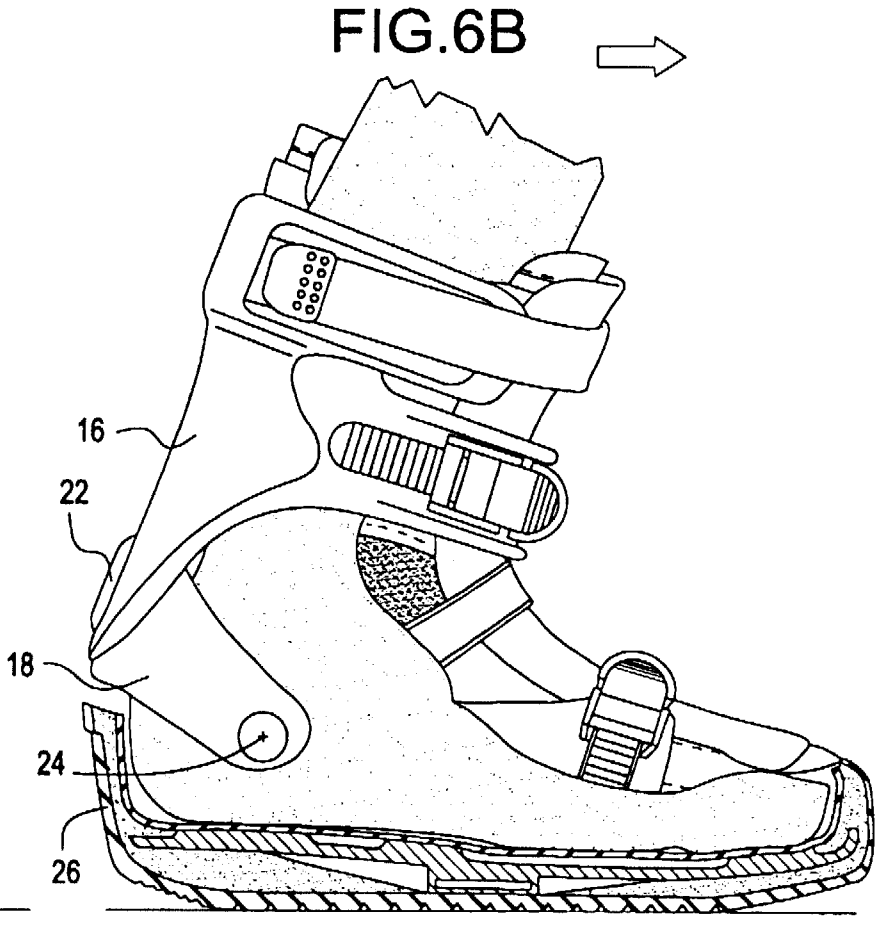
FIGS. 6A and 6B illustrate the freedom of forward inclination of the shaft portion.
Figure 6A:
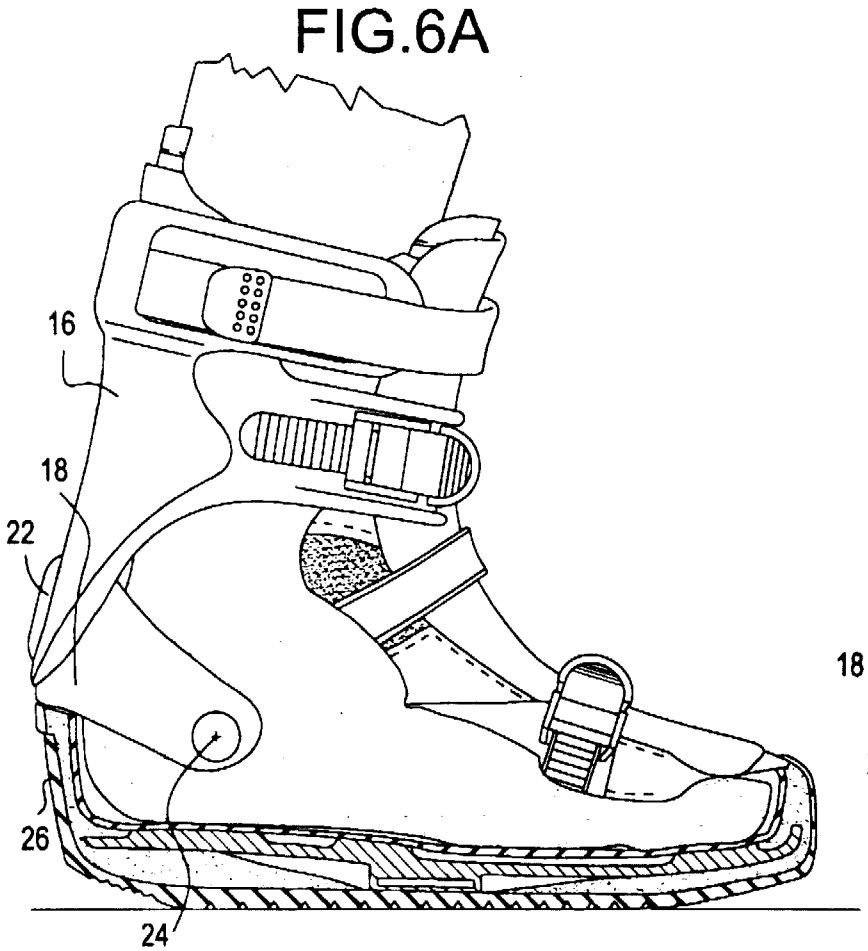

Likewise, FIGS. 6A and 6B show how the spoiler 18 can be moved between a support position on the rear strut of the reinforcement 26 (FIG. 6A), corresponding to the support position of the heel against the shaft portion and thus to the lifting movement of the front edge of the snow board, and a forwardly inclined position in which the spoiler 18 and the shaft portion 16 move away from the above-mentioned strut by simultaneous rotation about the axes of the studs 24, that is to say, when the athlete exerts the force directed to lifting the rear edge of the snow board. Furthermore, with regard to the type of fastening to the snow board and thus the type of attachment, the reinforcement 26 may have suitable fastening elements.

The invention has been described in relation to a preferred embodiment but it will be understood that structurally and mechanically equivalent modifications and variants are possible and may be provided for without departing from the scope of the invention.

For example, instead of a mid-sole of expanded plastics material, this mid-sole may be produced from compact plastics material, selecting a suitable material of this type for features of lightness and thermal insulation.

In addition, it is possible to adopt arrangements characteristic of snow shoes in the thickness of the mid-sole 36 by providing cavities for improved thermal insulation, or to add reinforcing elements which can increase mechanical resistance to the particular forces which, in connection with the forces applied by the athlete to the sports equipment, may result in the form of a reaction which also acts on the mid-sole apart from on the actual reinforcing element.

According to another possible variant, the mid-sole may also be produced directly, even if in a different material and using optionally different manufacturing technology, on the reinforcing element, in which case the procedure for forming the shoe is varied by providing for the adhesive bonding of one side of the resulting composite element to the upper and the other side to the sole or tread.

We claim:

1. Snow board shoe comprising an upper provided with a lower edge and an insole attached thereto, a sole, and fastening means for being locked to an attachment of an upper surface of a snow board, wherein:

a reinforcing element and a mid-sole made of plastic material are interposed between the upper and the sole, the reinforcing element having peripheral sidewalls which surround and are in contact with a lower part of the upper so as to extend along a lower edge of the upper, and the reinforcing element further having lower walls extending inwards of the shoe for supporting the lower edge of the upper attached to the insole, the mid-sole surrounding externally the reinforcing element and forming a junction with the sole, and wherein;

the shoe is provided in a heel zone with a U-shaped spoiler which has ends hinged to the reinforcing element, and with a U-shaped shaft portion extending above the spoiler, partially enclosing a rear part of the upper and being anchored to the spoiler by a stud, about which the shaft portion can be inclined.

2. Shoe according to claim 1, wherein the reinforcing element has an internal plate, thereby improving resistance of the sole, and thus of the shoe, to release loads without substantial deformation.

3. Shoe according to claim 1, wherein the reinforcing element is provided with cavities in rigid portions thereof for being penetrated by a plastic material of the mid-sole, thereby increasing a structural resistance of the shoe and dampening vibrations thereof.

4. Shoe according to claim 1, wherein the reinforcing element and the mid-sole are respectively made of semi-rigid and expanded plastic material.

* * * * *